United States Patent [19]

Walker

[11] Patent Number: 4,747,366

[45] Date of Patent: May 31, 1988

[54] DEVICE FOR PROTECTING WATER SPRINKLERS WHILE PAINTING

[76] Inventor: Robert C. Walker, 1030 S. Austin, Santa Ana, Calif. 92704

[21] Appl. No.: 49,286

[22] Filed: May 12, 1987

[51] Int. Cl.[4] ..... B05C 11/16

[52] U.S. Cl. ..... 118/504; 427/282; 427/300

[58] Field of Search ..... 427/282; 118/505, 504, 118/301

[56] References Cited

U.S. PATENT DOCUMENTS

| | | | |
|---|---|---|---|
| 1,422,964 | 7/1922 | Greenbaum | 118/500 |
| 2,728,323 | 12/1955 | Walton et al. | 118/505 |
| 2,925,064 | 2/1960 | Kahn | 118/505 |
| 4,033,803 | 7/1977 | Coder | 156/71 |
| 4,313,970 | 2/1982 | Jones et al. | 427/208.4 |
| 4,327,663 | 5/1982 | Izzo | 118/505 |
| 4,327,663 | 5/1982 | Izzo | 118/505 |
| 4,656,058 | 4/1987 | Stark | 118/505 |

*Primary Examiner*—Thurman K. Page
*Assistant Examiner*—L. R. Horne
*Attorney, Agent, or Firm*—Klein & Szekeres

[57] ABSTRACT

A device for protecting the beauty rims of ceiling-mounted water sprinklers comprises a shield member having a closed end removably attached to one end of an elongate handle. The shield member has an open end terminating in a flared lip, the interior surface of which is provided with a ring of adhesive material. The method of using the device includes the steps of (a) attaching the closed end of the shield member to the handle end; (b) placing the open end of the shield member over the sprinkler to cover the sprinkler and the rim, whereby the adhesive material adheres to the rim; (c) removing the handle from the closed end of the shield member, leaving the shield member attached to the rim by the adhesive material; (d) painting the ceiling around the shield member; and (e) removing the shield member from the rim.

4 Claims, 1 Drawing Sheet

FIG. 1
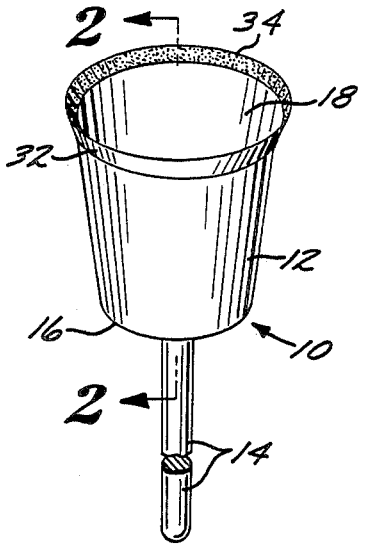
FIG. 2
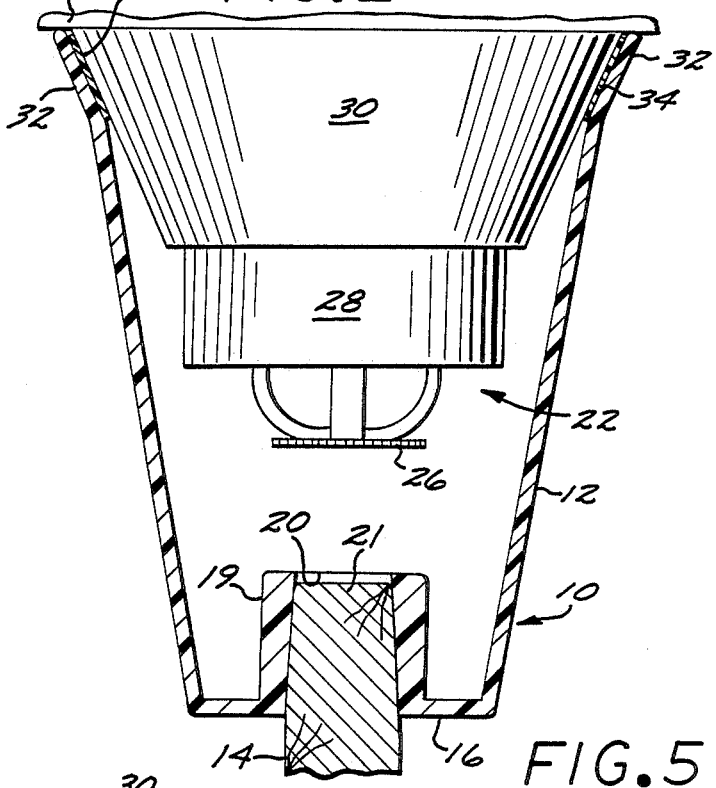
FIG. 5
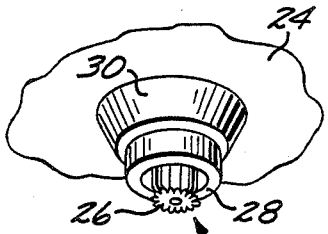
FIG. 3
FIG. 4
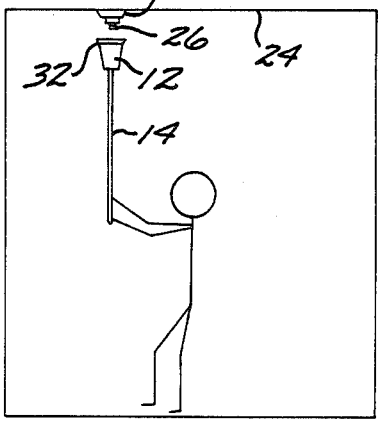
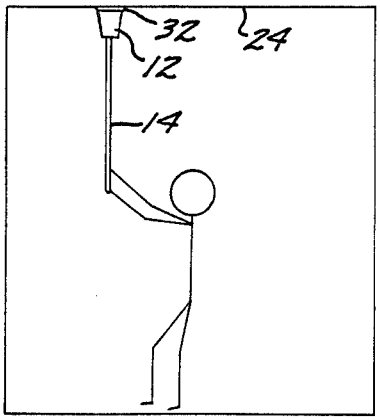
FIG. 6
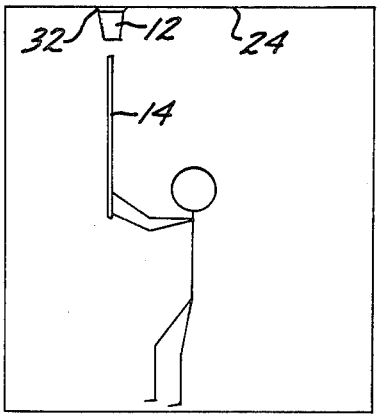
FIG. 7
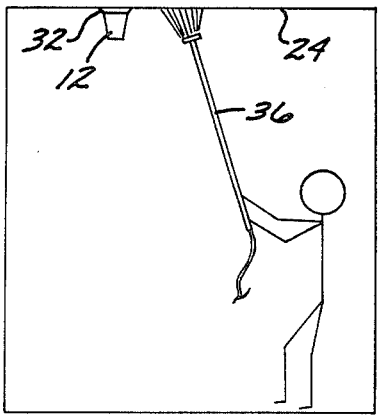
FIG. 8
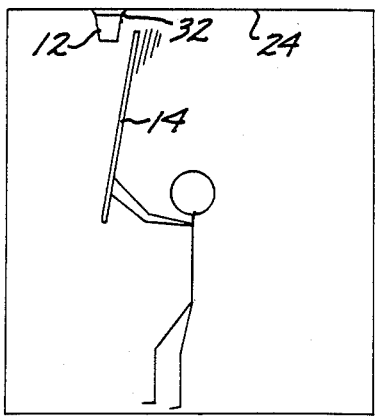

DEVICE FOR PROTECTING WATER SPRINKLERS WHILE PAINTING

BACKGROUND OF THE INVENTION

This invention relates to the general field of painting devices and methods. More particularly, it relates to a device that facilitates the painting of ceilings that have sprinkler systems installed therein, and to the method of using such a device.

Water sprinkler systems installed in ceilings are in common use for fire protection. Such systems pose special problems, however, when the ceiling is to be painted. In particular, there is a problem with keeping paint from being applied to the protective and decorative rims (sometimes called "beauty rims") which surround the sprinkler heads. Typically, the protection of these rims while painting has required the laborious effort of taping over the beauty rims prior to painting, and then removing the tape after painting. A fairly recent innovation is the use of a hand-held, removable shield to cover the sprinklers. The use of this shield, however, requires the efforts of at least two people: one to hold the protective shield over each sprinkler rim, while the other paints the surrounding ceiling area. This "team" moves from sprinkler to sprinkler until the ceiling is painted. The shield used with this method is typically a cup-shaped device fixed to the end of a pole. This prior art device is similar to the "Door Knob Shield" disclosed in U.S. Pat. No. 4,327,663 to Izzo, but with a much longer handle, allowing the user to reach the ceiling-mounted sprinkler while standing on the floor.

While the above-described prior art device can produce satisfactory results if skillfully used, it is inefficient, due to the need for an extra person just to handle the shield device.

There has thus been a long-felt, but as yet unsatisfied, need for some means to protect the sprinkler rims that eliminates the requirement for a separate shield-handler, thereby allowing the painter to work alone.

SUMMARY OF THE INVENTION

Briefly, the present invention is a paint shielding device for sprinkler rims, comprising a shield element having an open end and a closed end, with its closed end removably attached to a long handle. The open end of the shield element is dimensioned to conform to the exterior surface of the sprinkler rims to be protected. The inside surface of the open end has an adhesive applied to it, allowing the shield element to stick to the rim.

The present invention also encompasses the method of using the novel shielding device. Specifically, a shield element is first attached to one end of the handle. The handle is then used to place the shield element over the sprinkler, allowing the shield element to stick to the rim by means of the adhesive. The handle is then removed from the shield element, which remains stuck to the rim. A new shield element is attached to the handle, and the process is repeated with the next sprinkler, and so on, until all sprinklers in the room are covered. The ceiling is then painted. When painting is completed, the handle is used to dislodge the shield elements from the sprinklers.

In a specific preferred embodiment of the invention, the shield element is a frusto-conical cup, open at its wider end, and with a socket in its closed narrower end.

The socket is dimensioned for receiving the end of the pole with a frictional fit to facilitate removal. The open end of the cup has a flared lip, the inner surface of which is provided with a ring of double-sided tape for removable attachment to the sprinkler rim.

As will be better appreciated from the detailed description which follows, the present invention allows one person both to paint a ceiling while also protecting the sprinkler rims, thereby eliminating the previous need for an extra worker.

BRIEF DESCRIPTION OF THE DRAWINGS

FIG. 1 is a perspective view of a paint-shielding device in accordance with a preferred embodiment of the present invention;

FIG. 2 shows the device of FIG. 1, taken in cross-section along line 2—2 of FIG. 1, installed on a typical ceiling-mounted water sprinkler;

FIG. 3 is a perspective view of a typical ceiling-mounted water sprinkler, of the type shown in FIG. 2; and FIGS. 4 through 8 are simplified representations of the paint-shielding device in use, showing its method of use.

DETAILED DESCRIPTION OF THE INVENTION

A paint-shielding device 10, in accordance with a preferred embodiment of the present invention, is shown in detail in FIGS. 1 and 2. The device 10 comprises a shield or cover member 12 removably attached to one end of a handle 14. The shield member 12 is preferably in the general form of a frusto-conical cup, having a closed narrow end 16 and a wider, open end 18. The closed end 16 has a central recess 19 that forms a socket 20. As shown in FIG. 2, the socket 20 is dimensioned to receive one end 21 of the handle 14 with a snug frictional fit.

The shield member 12 is dimensioned to cover a water sprinkler 22, of the type that is typically installed in a ceiling 24 for fire protection. The sprinkler 22 (shown in FIGS. 2 and 3) comprises a sprinkler head 26 which protrudes downwardly from a protective receptacle 28. Surrounding the receptacle 28 is a protective and decorative annular rim 30 (sometimes called a "beauty rim"), the upper end of which abuts against the ceiling.

Referring once again to FIGS. 1 and 2, the shield member 12 has an outwardly-flared lip 32 terminating its open end 18. The inner surface of the lip 32 is provided with an adhesive ring 34. This adhesive ring 34 is preferably formed of a double-sided tape (i.e., a tape with adhesive on both sides). Other types of adhesive materials may be used as well. As shown in FIG. 2, the interior of the lip 32 is dimensioned and configured to conform to the exterior surface of the beauty rim 30, allowing the adhesive ring 34 to adhere to the rim 30 when the shield member 12 is placed over the sprinkler 22.

The method of using the device of FIGS. 1 and 2 is illustrated in FIGS. 4 through 8. Referring first to FIGS. 4 and 5, a shield member 12 is attached to one end of the handle 14 by inserting the handle end 21 into the socket 20, as previously described. The shield member 12 is then placed over the sprinkle 22 so that the entire sprinkler, including the rim 30, is covered. The adhesive ring 34 keeps the shield member 12 attached to the rim 30 when the handle 14 is removed from the socket 20 by a downward pull and a slight twist.

The steps of FIGS. 4, 5, and 6 are repeated for each sprinkler until all sprinklers are covered. The ceiling is then painted, as shown in FIG. 7, either with a paint sprayer 36 or with a roller (not shown). Finally, when the ceiling is completely painted, the shield members are removed by lightly rapping them with the handle 14, as shown in FIG. 8, to break the adhesion between the adhesive material and the rim.

The shield members 12 are advantageously made of a lightweight plastic. Their frusto-conical shape, which permits stacking, facilitates storage when not in use.

The handle 14 can be of whatever length is suitable for the height of the ceiling to be painted. Lengths of about two to six feet will accommodate most ceilings. The handle 14 can be a wooden pole, as shown in the drawings, or it can be a length of metal or plastic tubing.

Although a specific preferred embodiment of the invention has been described above, various modifications will suggest themselves to those skilled in the pertinent arts. For example, the handle 14 can be of a telescoping construction, for maximum versatility. The shield members 12 can be made in a variety of sizes and configurations, to accommodate sprinklers of diverse designs. Also, as previously mentioned, a wide variety of adhesive materials are available for use as the adhesive ring 34. These and other modifications which may suggest themselves should be considered within the spirit and scope of the present invention, as defined in the claims which follow.

What is claimed is:

1. A device for shielding a ceiling-mounted water sprinkler, of the type having an annular beauty rim, said device comprising:

an elongate handle having an end;

a shield member having an open end and a closed end;

first means in said closed end for removable attachment to said handle end; and second means in said open end for removable attachment to said beauty rim, said open end terminating in an outwardly-flared lip having internal dimensions generally conforming to the exterior surfaces of said rim, said second means including an adhesive tape material removably applied to the interior surface of said lip for the adhesive attachment of said second means to said beauty rim.

2. The device of claim 1, wherein said first means includes a recess in said closed end forming a socket which frictionally receives said handle end.

3. The device of claim 1, wherein said shield member is generally frusto-conical, with said open end being wider than said closed end.

4. The device of claim 1, wherein said adhesive material is a double-side adhesive tape.

* * * * *